US010228157B2

(12) United States Patent
Zoppas et al.

(10) Patent No.: US 10,228,157 B2
(45) Date of Patent: Mar. 12, 2019

(54) HEATER FOR HOUSEHOLD APPLIANCES

(71) Applicant: I.R.C.A. S.P.A. Industria Resistenze Corazzate e Affini, San Vendemiano (IT)

(72) Inventors: Federico Zoppas, Treviso (IT); Angelo Irrera, San Vedemiano (IT); Andrea Pradal, Oderzo (IT); Maurizio Biasi, Fontanelle (IT)

(73) Assignee: I.R.C.A. S.P.A. Industria Resistenze Corazzate e Affini, San Vendemiano (IT)

( * ) Notice: Subject to any disclaimer, the term of this patent is extended or adjusted under 35 U.S.C. 154(b) by 138 days.

(21) Appl. No.: 15/112,266

(22) PCT Filed: Jan. 20, 2015

(86) PCT No.: PCT/IB2015/050429
§ 371 (c)(1),
(2) Date: Jul. 18, 2016

(87) PCT Pub. No.: WO2015/107510
PCT Pub. Date: Jul. 23, 2015

(65) Prior Publication Data

US 2016/0334133 A1 Nov. 17, 2016

(30) Foreign Application Priority Data

Jan. 20, 2014 (IT) ..... PD2014A0010

(51) Int. Cl.
*F24H 1/10* (2006.01)
*A47L 15/42* (2006.01)
(Continued)

(52) U.S. Cl.
CPC ..... *F24H 1/102* (2013.01); *A47L 15/4225* (2013.01); *A47L 15/4285* (2013.01);
(Continued)

(58) Field of Classification Search
CPC .... F24H 1/102; F24H 9/2028; A47L 15/4225; A47L 15/4285; D06F 39/04;
(Continued)

(56) References Cited

U.S. PATENT DOCUMENTS 8,245,718 B2 8/2012 Buesing

FOREIGN PATENT DOCUMENTS

CN 202195572 * 4/2012
CN 202195572 U 4/2012
(Continued)

OTHER PUBLICATIONS

Written Opinion of the ISA dated May 22, 2015 for PCT appln. No. PCT/IB2015/050429.

*Primary Examiner* — Shawntina Fuqua
(74) *Attorney, Agent, or Firm* — Abelman, Frayne & Schwab

(57) ABSTRACT

A centrifugal pump for household appliances comprising a cover (1) having:—a first face internal to the pump adapted to be in contact with an operating fluid, and a second face external to the pump, opposite to the first face and provided with an annular groove (16) forming a projection inwards of the pump,—a heating element (11) fixed in the annular groove (16),—a first support element (21) arranged on the second face and provided with a first constraint (31) adapted to be fixed to a first safety device (41), said first support element (21) being in thermal contact with said operating fluid, whereby the first safety device (41) is adapted to come in thermal contact with the operating fluid,—a second support element (22) arranged on the second face, distinct from the first support element (21) and provided with a second constraint (32) adapted to be fixed to a second safety device (42), said second support element (22) being in thermal contact with said heating element (11), whereby the second
(Continued)

safety device (42) is adapted to come in thermal contact with the heating element (11).

8 Claims, 4 Drawing Sheets

(51) Int. Cl.

| | |
|---|---|
| ***D06F 39/04*** | (2006.01) |
| ***D06F 39/08*** | (2006.01) |
| ***F24H 9/20*** | (2006.01) |
| ***F04D 15/00*** | (2006.01) |
| ***F04D 29/58*** | (2006.01) |
| *F04D 29/42* | (2006.01) |

(52) U.S. Cl.
CPC ..... *D06F 39/04* (2013.01); *D06F 39/085* (2013.01); *F04D 15/0077* (2013.01); *F04D 15/0088* (2013.01); *F04D 29/426* (2013.01); *F04D 29/588* (2013.01); *F24H 9/2028* (2013.01); *F04D 29/4293* (2013.01); *F24D 2220/0207* (2013.01)

(58) Field of Classification Search
CPC ..... D06F 39/085; F04D 15/0077; F04D 15/0088; F04D 29/426; F04D 29/588; F04D 29/4293; F24D 2220/0207
See application file for complete search history.

(56) References Cited

FOREIGN PATENT DOCUMENTS

| | | | |
|---|---|---|---|
| DE | 20107363 | * | 7/2001 |
| DE | 20107363 U1 | | 7/2001 |

* cited by examiner

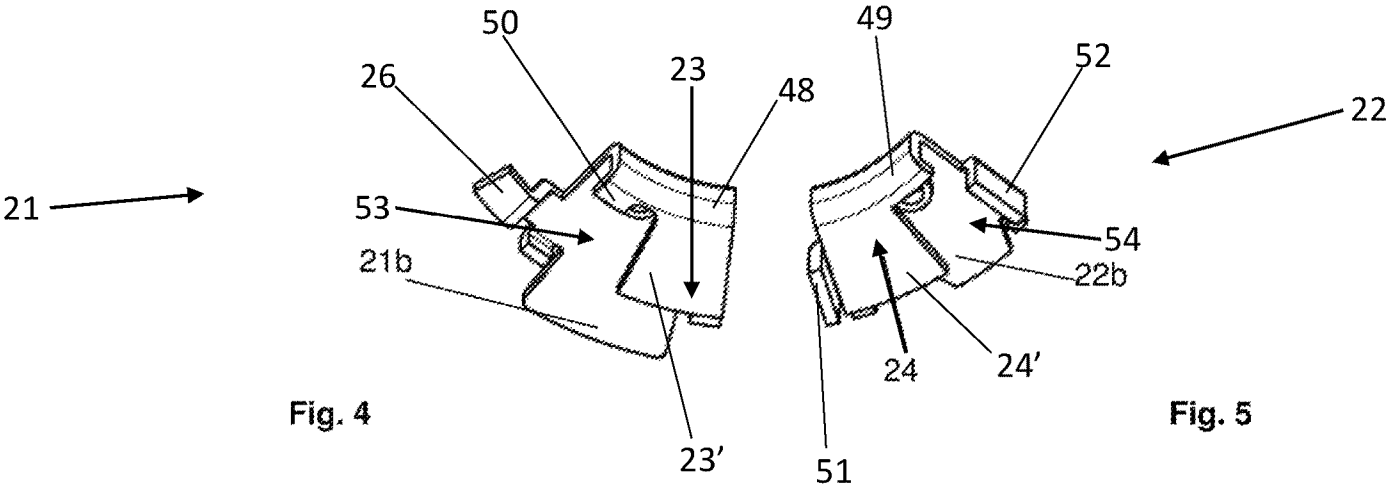
Fig. 5
Fig. 4
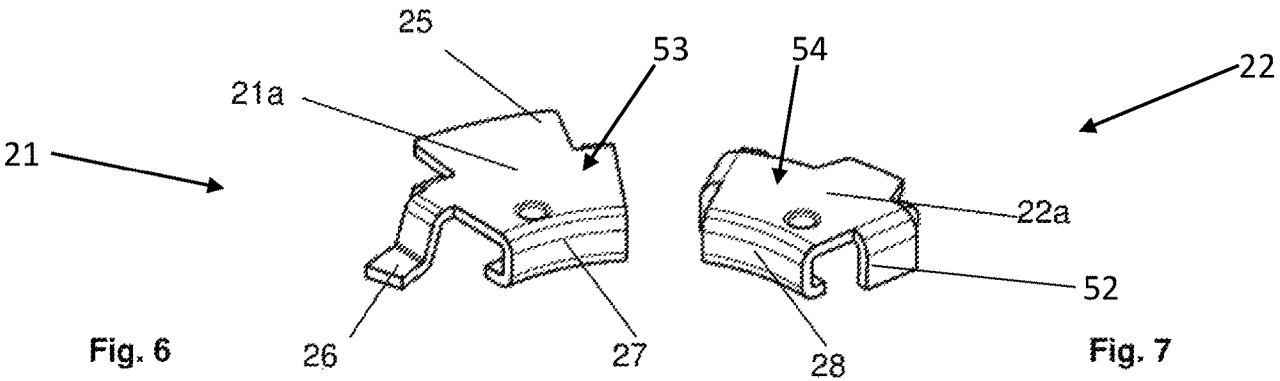
Fig. 7
Fig. 6

HEATER FOR HOUSEHOLD APPLIANCES

CROSS REFERENCE TO RELATED APPLICATION

This application claims benefit under 35 U.S.C. § 371 to international application No. PCT/IB2015/050429, filed on Jan. 20, 2015, which claims priority to Italian application no. PD2014A000010, filed Jan. 20, 2014, the contents of which are incorporated by reference in their entireties.

FIELD OF THE INVENTION

The present invention relates to a centrifugal pump for household appliances, in particular a cover of centrifugal pump.

BACKGROUND ART

In many applications of household appliances, a heater is required to bring an operating fluid, typically, to the operating temperature required.

Heaters of the above type are typically, although not exclusively, coupled with circulating pumps of the above household appliances.

Such heaters typically include a heating element, normally consisting of a resistance thermometer, and a device for temperature control both in normal operating conditions and in any anomalous or failure conditions. In theory, in order to monitor the temperature of the heater under all operating conditions, a single thermostat would be sufficient. However, to meet some safety principles, such as the presence of a redundant secondary protection in case of failure of the main protection, the thermostat that acts as the main protection must be complemented with a second safety device, typically a thermal fuse.

The thermal fuse is normally used for abnormal and failure condition monitoring and for this reason, it must not intervene in the normal operation of the heater and at the same time, in abnormal and failure conditions it must start promptly before dangerous situations can occur, at the expense of any parts nearby. Laboratory tests show that, in order meet these specifications, the operating temperature of the thermostat must be around 100° C. while that of the thermal fuse is generally around 200° C. In order to meet these requirements, the thermostat is placed on a surface mainly in contact with water and which therefore, under normal operating conditions, is at a temperature of about 85-90° C., while the thermal fuse is placed on a surface mainly in contact with the heating element and which therefore, under normal operating conditions, is at a temperature of about 140-160° C.

If the thermostat and thermal fuse are placed on the same support, this must necessarily be set at a temperature of 85-90° C. to allow the thermostat to perform its function. This would have as a contraindication the slowness of intervention of the thermal fuse, or rather its uselessness, since experimental tests confirm that usually the material thermal fuses are made of, in worst failure conditions, i.e. without circulating water, melts after 10-12 seconds while the thermal fuse would need around 20-25 seconds to intervene.

In order to overcome this drawback, it is known to provide a single support with two distinct zones subject to different temperatures, one reserved to the thermostat and the other to the thermal fuse. A technical solution of this type is for example described in U.S. Pat. No. 7,560,672.

However, such a solution cannot yet be considered optimal. In fact, the presence of a single support implicitly provides for the presence of a thermal bridge between the two zones intended for the thermostat and the thermal fuse, respectively.

SUMMARY OF THE INVENTION

An object of the present invention is to provide a centrifugal pump for household appliances capable to effectively control the temperature of the operating fluid, typically water, and at the same time manage any abnormal or failure situations in a reasonable time.

This object is achieved by a centrifugal pump for household appliances which, according to claim 1, comprises a cover having:

- a first face internal to the pump adapted to be in contact with an operating fluid, and a second face external to the pump, opposite to the first face and provided with an annular groove forming a projection inwards of the pump,
- a heating element fixed in the annular groove,
- a first support element arranged on the second face and provided with a first constraint adapted to be fixed to a first safety device, said first support element being in thermal contact with said operating fluid, whereby the first safety device is adapted to come in thermal contact with the operating fluid,
- a second support element arranged on the second face, distinct from the first support element and provided with a second constraint adapted to be fixed to a second safety device, said second support element being in thermal contact with said heating element, whereby the second safety device is adapted to come in thermal contact with the heating element.

The centrifugal pump of the present invention, in particular the cover thereof, allows physically separating the two support elements intended for the thermostat and the thermal fuse, respectively. Advantageously, the shape and size of each support element can be defined and optimized irrespective of the shape and size of the other support element. Also the distance between the two support elements can be optimally defined without affecting other construction parameters, such as the size of the support elements themselves.

Preferably, the first support element comprises a first tab and the second support element comprises a second tab. The first tab and the second tab are in thermal contact with the operating fluid and with the heating element. Moreover, preferably according to this aspect, the first support element includes a first plate spaced apart from the heating element and connected to the first tab.

Preferably, said second support element includes a second plate spaced apart from said heating element and connected to said second tab.

The first plate and the second plate can have the same extension in height from the heating element, and in particular they can be coplanar, or they can have a different extension in height, for example the first support element can have an extension in height greater than the second support element.

Preferably, the heating element includes at least a first portion at a first temperature and a second portion at a second temperature, higher than the first temperature. Preferably, the first support element includes a third tab which is in thermal contact with the first portion and the second tab of the second support element is in thermal contact with the second portion.

Advantageously, the fact that the first support element includes a tab for connection with the portion at a lower temperature of the heating element allows managing even special abnormal conditions, such as the excessive formation of scale.

Preferably, the heating element is of electro-resistive type and extended between a first and a second pin adapted to be coupled to respective terminals of an electric potential source, and the at least one first portion is adjacent to the first pin.

Preferably, another first portion adjacent to the second pin is provided.

Preferably, the first safety device is a thermostat.

Preferably, the second safety device is a thermal fuse.

BRIEF DESCRIPTION OF THE FIGURES

Further features and advantages of the invention will appear more clearly from the detailed description of preferred, but not exclusive, embodiments of a heater for household appliances according to the present invention, shown by way of a non-limiting example with the aid of the accompanying drawings, in which:

FIGS. 4 and 5 are two axonometric bottom views of two components of the cover in FIG. 1, respectively;

FIGS. 6 and 7 are two axonometric top views of the two components in FIGS. 4 and 5, respectively.

DETAILED DESCRIPTION OF THE INVENTION

Figure 1:
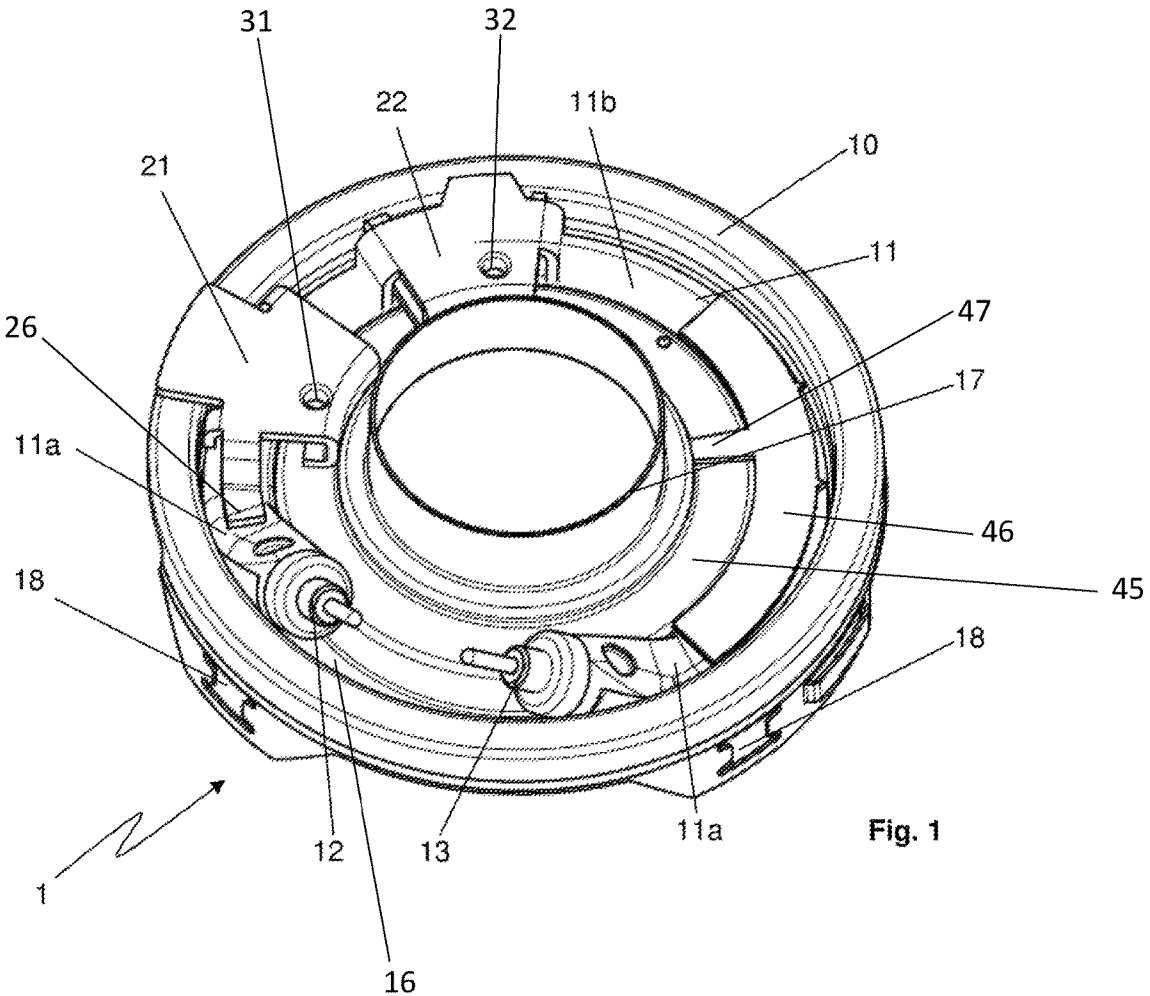
FIG. 1 is an axonometric view of a cover for centrifugal pump according to the present invention.
Figure 2:
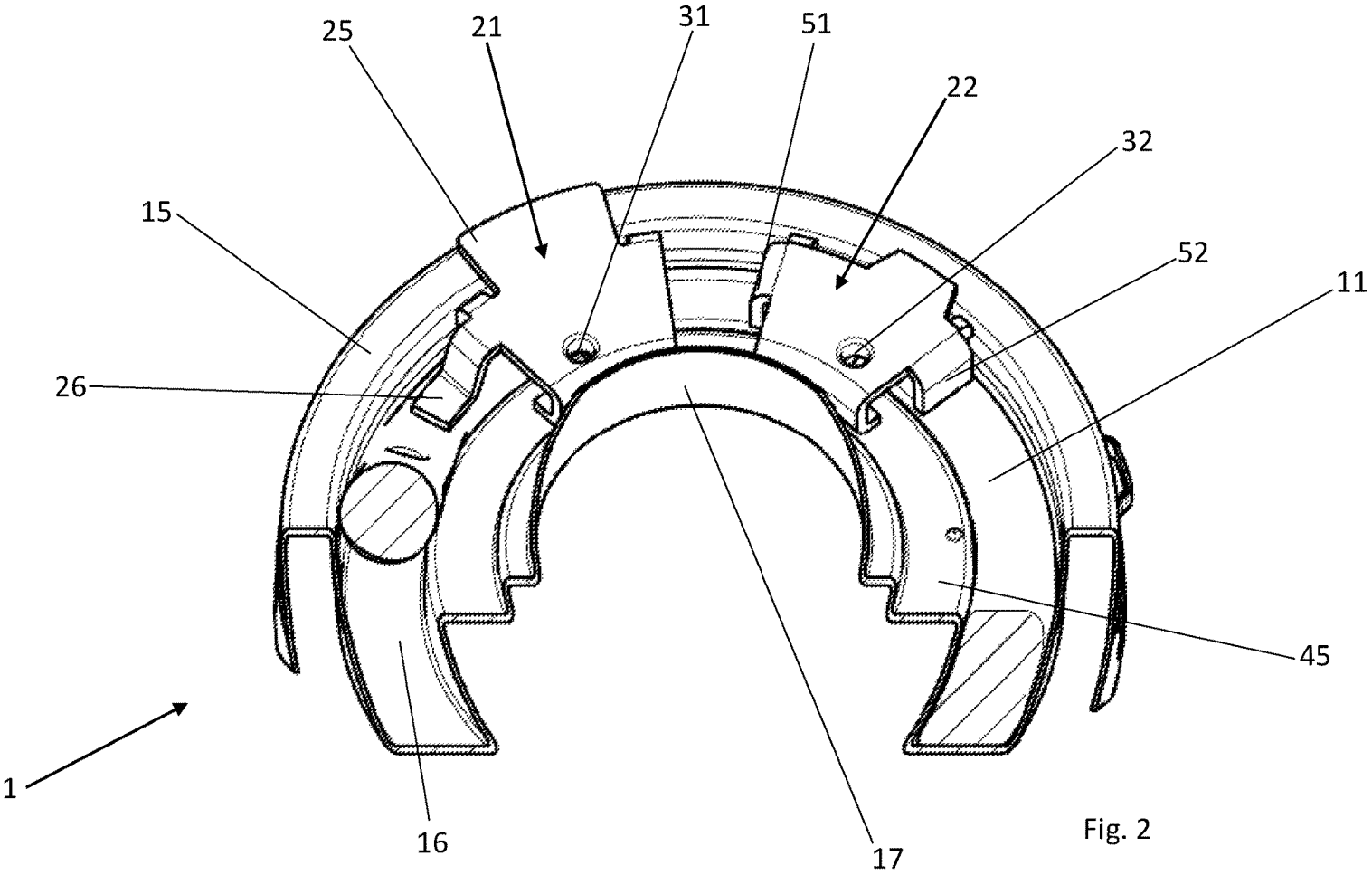
FIG. 2 is a first sectional view of the cover in FIG. 1.
Figure 3:
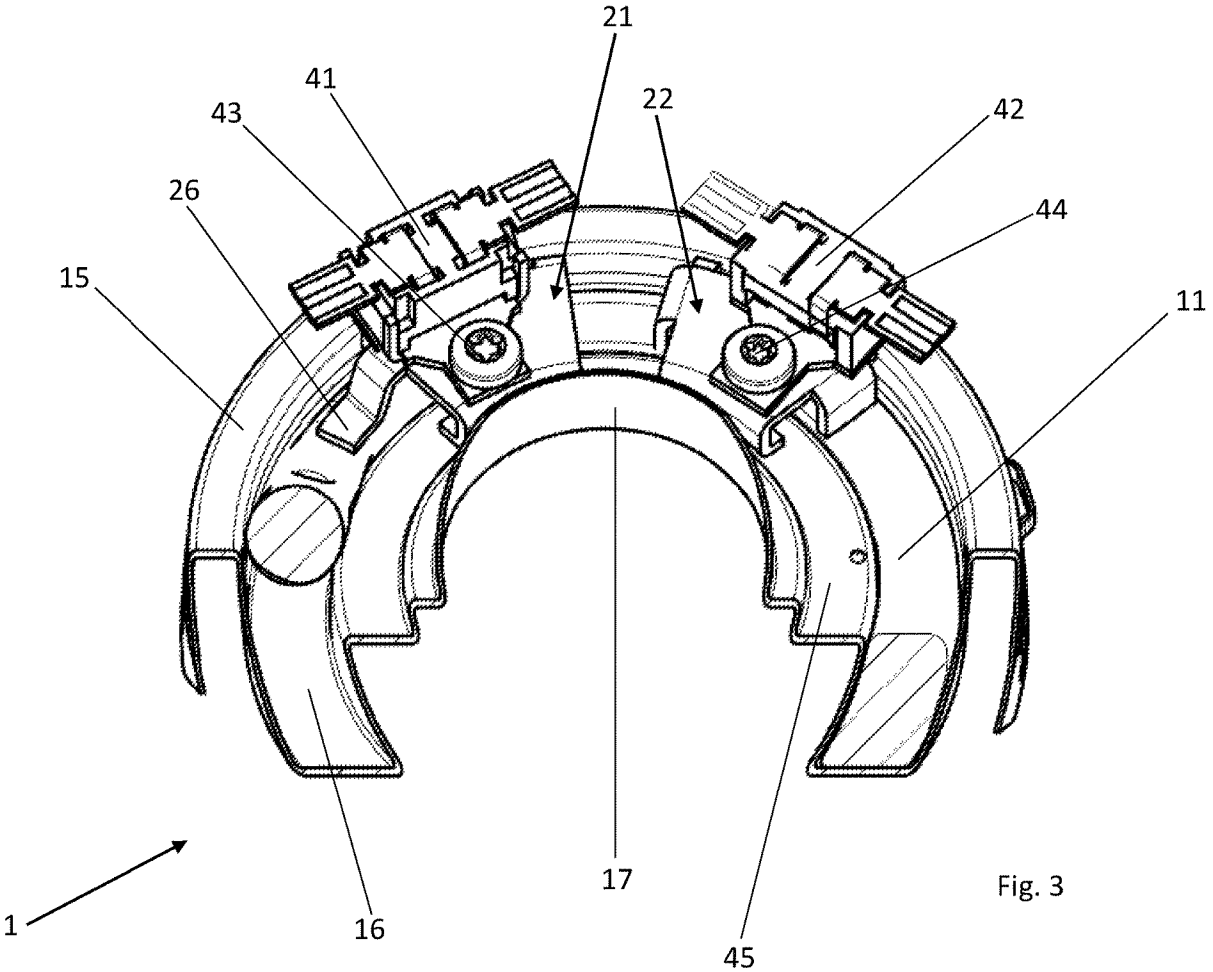
FIG. 3 is a second sectional view of the cover in FIG. 1 coupled to two safety devices.

With reference to the accompanying figures, a cover for centrifugal pump, in particular for household appliances, is indicated as a whole with reference numeral 1. Cover 1 is particularly, although not exclusively, usable for a circulating pump, not shown in the accompanying figures, of a dishwasher. However, more generally, the centrifugal pump of the present invention can also be used in a plurality of similar applications for household appliances, in particular where it is necessary to heat in a controlled manner an operating fluid and at the same time manage, through monitoring of temperature, specific abnormal or failure situations.

Cover 1 comprises a base 10 capable of being in contact with an operating fluid, typically water. In particular, a first face of the cover is susceptible of being in contact with the operating fluid, and a second face of the cover, opposite to the first face, is in thermal contact with the fluid. The cover is made of metal material, preferably stainless steel.

Base 10 is circular in shape with a raised edge 15, extending distally from the face of base 10 in contact with the fluid, and a central hole 17 which can be coupled with the suction conduit, not shown, of the circulating pump. Along the raised edge 15 there is a plurality of mating items 18, which extend from the face in contact with the fluid of the base 10, to constrain the base 10 to the outer housing of the circulating pump. The coupling elements 18 are, for example, of the snap type or other type per se known and conventional and therefore not described in further detail.

Base 10 further comprises a circular groove 16, basically rectangular in section, adjacent to the raised edge 15. In other words, groove 16 is defined by the raised edge 15 and by a circular inner area 45 which, seen in plan from the top, substantially is a circular crown and which is arranged around the central hole 17. Preferably, the height of the inner zone 45, measured from the bottom of groove 16, is less than the height of the raised edge 15. The thickness of cover 1 is thin enough so that the features of a face thereof that are raised are recesses of the other opposite face, and vice versa. For example, a relief zone of the face adapted to be in contact with the fluid, corresponds to groove 16, and a recess of the face adapted to be in contact with the fluid, corresponds to the inner zone 45. Cover 1 further comprises a heating element 11 accommodated and fixed, for example by welding and preferably by brazing, in the circular groove 16. The heating element 11 is of electro-resistive type, tubular in shape and extended between a first end pin 12 and a second end pin 13 susceptible of being coupled with the respective terminals of an electric potential source, not shown, so as to allow the flow of current and the consequent generation of heat which allows heating the operating fluid in contact with cover 1. Pins 12 and 13 are raised in relation to the circular groove 16 and circular in shape, while the portion of heating element 11 between pins 12 and 13 is rectangular in shape so as to adapt to the shape of the section of the circular groove 16. The end portions 11*a* of the heating element 11 accommodated within the circular groove 16 and adjacent to pins 12, 13 are the part with the lowest temperature of the heating element 11, while the intermediate central portion 11*b* between pins 12, 13 is the part with the highest temperature of the heating element 11.

Cover 1 further comprises a first support element 21 provided with a first constraint 31, or fastening portion, consisting of a threaded hole, for a first safety device 41, adapted to control the temperature of the operating fluid under normal operating conditions and consisting of a thermostat. Thermostat 41 is fixed to the first support element 21 by means of a screw 43 screwed into the threaded hole 31. The first support element 21 is in thermal contact with the operating fluid to act as a thermal bridge between the operating fluid and thermostat 41. This allows the thermostat to control the temperature generated by the heating element 11, through the control of its power supply, so that the operating fluid is maintained at the normal operating temperature, typically in the range between 85° C. and 90° C.

Heater 1 further comprises a second support element 22 provided with a second constraint 32, or fastening portion, consisting of a threaded hole, for a second safety device 42, adapted to cut out the power supply of the heating element upon reaching predetermined abnormal or failure conditions which cause a sudden rise in temperature, for example the interruption of the operating fluid flow, i.e. in case of dry running. The second safety device 42 typically consists of a thermal fuse fixed to the second support element 22 by means of a screw 44 screwed into the threaded hole 32. The second support element 22 is in thermal contact with the heating element 11 to act as a thermal bridge between the heating element 11 and the second safety device 42. This allows the thermal fuse to intervene quickly if the temperature on the surface of the heating element 11 reaches temperatures considered not compatible with a normal operation of the heater, i.e. temperatures typically higher than 140° C.

The first and the second support elements 21, 22, which are two separate pieces, are mutually arranged in such a way that the first support element 21 is closer to one of the end portions 11*a*, which is colder, in relation to the second support element 22 and that this is instead closer to the central portion 11*b*, which is warmer. This allows the second support element 22 to be prompter, compared to the first support element 21, in feeling the temperature variations of the heating element.

The first and the second support elements 21, 22 comprise a respective plate-shaped element 53, 54, or plate, having a distal face 21*a*, 22*a* from the heating element 11, in contact with the thermostat 41 and the thermal fuse 42, respectively, and a proximal face 21*b*, 22*b* facing the heating element 11 and spaced therefrom. The distal 21*a*, 22*a* and proximal 21*b*, 22*b* faces are oriented substantially parallel to the heating element 11, in particular to the face thereof facing towards them.

The first and the second support elements 21, 22 comprise a first tab 23 and a second tab 24, respectively, parallel to the plate-shaped elements 53, 54 of the first and second support elements 21, 22, respectively, and respectively connected to them through a lateral connection 27, 28, substantially orthogonal to the first and to the second tab 23, 24 and proximal to the central hole 17. The first and the second tab 23, 24 have an initial portion 48, 49 which has the same circumferential extension as the connecting portion 27, 28. The first tab 23 continues, from the initial portion 48 thereof, in radial direction and distal from the central hole 17 with a first flap 23' and a second flap 50 which are circumferentially reciprocally spaced apart, forming a gap. The first flap 23' is in contact with the inner zone 45, and thus in thermal contact with the fluid and with the heating element 11; the second flap 50, which is smaller in size compared to the first flap 23', extends in a radial direction and distal from the central hole 17, being in contact with the inner zone 45 but not in contact with the heating element 11. The second tab 24 of the second support element 22 continues, from the initial portion 49 thereof, with a flap 24' which extends in radial direction and distal from the central hole 17, which is in contact with the inner zone 45 and with the heating element 11. The circumferential extension of flap 24' is less than the circumferential extension of the initial portion 49. The contact with the inner zone 45 of the first and of the second tab 23, 24 provides a better heat distribution, providing a better thermal contact for the thermostat and the thermal fuse, respectively.

In particular, the first tab 23 allows the first support element 21 to be in contact with the heating element so as to feel the temperature thereof and allow the thermostat, and more generally the control system to which the thermostat is connected, to manage, together with the water temperature in normal operation, also other potentially harmful conditions but not such as to require the intervention of the fuse mounted on the second support element 22, for example the presence of air bubbles in the operating fluid which may bring the measured temperature to values above 100° C., but still lower than the triggering temperature of the thermal fuse.

Preferably, the first support element 21 further comprises a third tab 25, which is part of the plate-shaped element 50, in contact with the raised edge 15 of base 10 and raised thereon.

Moreover, preferably, the first support element 21 has a total size greater than the second support element. This helps to allow the first support element 21 to be mainly sensitive to temperature variations of the operating fluid and the second support element 22 to be mainly sensitive to temperature variations of the heating element 11. Preferably, the two support elements 21, 22 have the same extension in height, i.e. in distal direction in relation to the heating element 11. Even more preferably, the two plate-shaped elements 53, 54 are coplanar. Alternatively, the extension in height of the first support element 21 is greater than that of the second support element 22. Moreover, preferably, the distal face from the bottom of groove 16 of the inner zone 45 is coplanar with the distal face from the bottom of groove 16 of the resistive element 11.

Moreover, the first support element 21 comprises a fourth tab 26, smaller in size compared to the first and third tab 23, 25, connecting the plate-shaped element 50 of the first support element 21 with the end portion 11*a*, at a lower temperature, of the heating element 11. The fourth tab 26 allows the first support element 21 to be sensitive to temperature variations of less warm portion of the heating element. This allows the thermostat 41 to react promptly, before the intervention of the thermal fuse 42, to manage rises in temperature of the heating element 11, for example due to the formation of scale, which makes heat discharge more difficult.

The second support element 22 further comprises two lateral teeth 51, 52, which extend from the two opposite lateral edges, in circumferential direction, of the plate-shaped element 54, up to coming into contact with the heating element 11, to which they are welded.

The invention therefore achieves the above object while obtaining a plurality of further advantages. In particular, the particular shape of the support elements 21, 22 and the presence of additional tabs on the first support element allows managing a plurality of abnormal situations, such as the presence of air bubbles or scale, by means of the thermostat, and thus without the intervention of the fuse, which would necessarily require a replacement with a new fuse and thus a maintenance intervention.

Preferably, the heating element 11 is sized so as to be radially spaced from the raised edge 15, in particular from the inner lateral surface of the latter, i.e. that facing the central hole 17, leaving a portion of groove 16 exposed. In this case, a portion of the heating element 22 is brazed to the bottom of groove 16, and the inner lateral surface of the heating element 11 is brazed to the lateral surface of the inner zone 45, surrounding it.

Preferably, in this case, a stiffening element 46 is provided, adapted to provide greater mechanical resistance to the heating element 11, substantially flat, having a face fixed, for example by welding, to the distal face from the bottom of groove 16 of the heating element 11, covering a portion of the latter. The stiffening element 46 is preferably arranged between the end portion 11*a*, opposite to that which is in contact with the first support element 21, and the second support element 22. Preferably, the stiffening element 46 is provided with a flap 47 which extends in the radial direction towards the inner zone 45 and is in contact with the latter, so as to provide a better heat distribution.

According to a variant, the tabs of the first and second support element, which are in contact with the heating element, have a further portion which extends approximately perpendicularly, so as to be arranged between the inner zone 45 and the heating element. Thanks to this portion, which is in contact with the heating element, further heat exchange surface is provided.

The invention claimed is:

1. A centrifugal pump for household appliances comprising a cover having:

a first face internal to the pump configured to be in contact with an operating fluid, and a second face external to the pump, opposite to the first face and provided with an annular groove forming a projection inwards of the pump, a heating element fixed in the annular groove, a first support element arranged on the second face and provided with a first constraint configured to be fixed to a first safety device, said first support element being in thermal contact with said operating fluid, wherein the first safety device is configured to come in thermal contact with the operating fluid, a second support element arranged on the second face, distinct from the first support element and provided with a second constraint configured to be fixed to a second safety device, said second support element being in thermal contact with said heating element, wherein the second safety device is configured to come in thermal contact with the heating element, wherein said first support element comprises a first tab and said second support element comprises a second tab, and wherein the first tab and the second tab are in thermal contact with said operating fluid and with said heating element.

2. The centrifugal pump according to claim 1, wherein said first support element comprises a first plate spaced from said heating element and connected to said first tab.

3. The centrifugal pump according to claim 2, wherein said second support element comprises a second plate spaced from said heating element and connected to said second tab.

4. The centrifugal pump according to claim 3, wherein said first plate and said second plate have the same extension in height from to the heating element.

5. The centrifugal pump according to claim 2, wherein said first support element comprises a third tab, wherein said heating element comprises at least a first portion at a first temperature and a second portion at a second temperature, higher than the first temperature, and wherein said third tab is in thermal contact with said first portion and wherein said second tab is in thermal contact with said second portion.

6. The centrifugal pump according to claim 5, wherein said heating element is of electro-resistive type and extended between a first and a second pin configured to be coupled to respective terminals of an electric potential source, and wherein said at least one first portion is adjacent to the first pin.

7. The centrifugal pump according to claim 3, wherein said first support element comprises a third tab, wherein said heating element comprises at least a first portion at a first temperature and a second portion at a second temperature, higher than the first temperature, and wherein said third tab is in thermal contact with said first portion and wherein said second tab is in thermal contact with said second portion.

8. The centrifugal pump according to claim 4, wherein said first support element comprises a third tab, wherein said heating element comprises at least a first portion at a first temperature and a second portion at a second temperature, higher than the first temperature, and wherein said third tab is in thermal contact with said first portion and wherein said second tab is in thermal contact with said second portion.

* * * * *